US010662514B2

(12) United States Patent
Gupta et al.

(10) Patent No.: US 10,662,514 B2
(45) Date of Patent: May 26, 2020

(54) AA6XXX ALUMINUM ALLOY SHEET WITH HIGH ANODIZED QUALITY AND METHOD FOR MAKING SAME

(71) Applicant: Novelis Inc., Atlanta, GA (US)

(72) Inventors: Alok Gupta, Kingston (CA); Daehoon Kang, Kennesaw, GA (US); Rajeev G. Kamat, Marietta, GA (US); Devesh Mathur, Marietta, GA (US)

(73) Assignee: NOVELIS INC., Atlanta, GA (US)

( * ) Notice: Subject to any disclaimer, the term of this patent is extended or adjusted under 35 U.S.C. 154(b) by 0 days.

(21) Appl. No.: 15/212,521

(22) Filed: Jul. 18, 2016

(65) Prior Publication Data

US 2017/0022592 A1 Jan. 26, 2017

Related U.S. Application Data

(60) Provisional application No. 62/194,328, filed on Jul. 20, 2015.

(51) Int. Cl.
*C22F 1/05* (2006.01)
*C22F 1/047* (2006.01)
(Continued)

(52) U.S. Cl.
CPC ..... *C22F 1/047* (2013.01); *C22C 21/08* (2013.01); *C22F 1/043* (2013.01); *C22F 1/05* (2013.01); *C25D 11/04* (2013.01)

(58) Field of Classification Search
CPC ..... C22C 21/08; C22F 1/05
See application file for complete search history.

(56) References Cited

U.S. PATENT DOCUMENTS 3,990,922 A * 11/1976 Gullotti ..... C22F 1/05 148/690
6,652,678 B1 * 11/2003 Marshall ..... C22C 21/02 148/552

(Continued)

FOREIGN PATENT DOCUMENTS

JP S6487752 A 3/1989
JP H10121177 A 5/1998

(Continued)

OTHER PUBLICATIONS

"International Alloy Designations and Chemical Composition Limits for Wrought Aluminum and Wrought Aluminum Alloys," Registration Record Series: Teal Sheets, Feb. 1, 2009, The Aluminum Association, Inc., 35 pages.

(Continued)

*Primary Examiner* — George Wyszomierski
*Assistant Examiner* — Janell C Morillo
(74) *Attorney, Agent, or Firm* — Kilpatrick Townsend & Stockton LLP

(57) ABSTRACT

Provided herein are anodized quality AA6xxx series aluminum alloy sheets and methods for making anodized quality AA6xxx series aluminum alloy sheets. Also described herein are products prepared from the anodized quality AA6xxx series aluminum alloy sheets. Such products include consumer electronic products, consumer electronic product parts, architectural sheet products, architectural sheet product parts, and automobile body parts.

15 Claims, 2 Drawing Sheets

(51) Int. Cl.

| | |
|---|---|
| ***C22F 1/043*** | (2006.01) |
| ***C22C 21/08*** | (2006.01) |
| ***C25D 11/04*** | (2006.01) |

(56) References Cited

U.S. PATENT DOCUMENTS

| | | | | |
|---|---|---|---|---|
| 2006/0032560 | A1 | 2/2006 | Kehl et al. | |
| 2007/0209778 | A1 | 9/2007 | Gallerneault et al. | |
| 2011/0017370 | A1* | 1/2011 | Takaki | C22C 21/08 148/692 |
| 2014/0190595 | A1 | 7/2014 | Kehl et al. | |
| 2015/0152535 | A2 | 6/2015 | Kehl et al. | |
| 2015/0354044 | A1* | 12/2015 | Shishido | C22C 21/08 420/534 |
| 2016/0047021 | A1* | 2/2016 | Nakamura | C22C 21/08 420/532 |

FOREIGN PATENT DOCUMENTS

| | | | | |
|---|---|---|---|---|
| JP | 2002140664 | A | 5/2002 | |
| JP | 2003518192 | A | 6/2003 | |
| JP | 2007247000 | A | 8/2007 | |
| JP | 2011202240 | A | 10/2011 | |
| JP | 2012140664 | A | 7/2012 | |
| JP | 5052895 | B2 | 10/2012 | |
| WO | 0052219 | A1 | 9/2000 | |
| WO | 02090609 | A1 | 11/2002 | |
| WO | WO 2014126073 | A1 * | 8/2014 | C22C 21/08 |
| WO | WO 2014168147 | A1 * | 10/2014 | C22C 21/08 |
| WO | 2016115120 | A1 | 7/2016 | |

OTHER PUBLICATIONS

International Patent Application No. PCT/US2016/042729, International Search Report and Written Opinion dated Sep. 29, 2016, 11 pages.
Korean Patent Application No. 10-2017-7007239, Office Action dated May 11, 2017, 9 pages.
Canadian Patent Application No. 2,961,443, Office Action dated May 15, 2017, 4 pages.
Canadian Patent Application No. 2,961,443, Notice of Allowance dated Jan. 5, 2018, 1 page.
European Patent Application No. 16745583.1, Office Action dated Jan. 11, 2018, 5 pages.
Chinese Patent Application No. 201680002343.9, Office Action dated Jan. 11, 2018, 20 pages.
International Patent Application No. PCT/US2016/042729, International Preliminary Report on Patentability dated Feb. 1, 2018, 8 pages.
Japanese Patent Application No. 2017-512712, Notice of Decision to Grant dated Feb. 6, 2018, 3 pages.
Korean Patent Application No. 10-2017-7007239, Office Action dated Nov. 6, 2017, 6 pages.
Japanese Patent Application No. 2017-512712, Office Action dated Aug. 17, 2017, 5 pages.
Canadian Patent Application No. 2,961,443, Office Action dated Aug. 23, 2017, 3 pages.
Chinese Patent Application No. 201680002343.9, Office Action dated Aug. 23, 2017, 17 pages.
Korean Patent Application No. Oct. 2017-7007239, Office Action dated Sep. 12, 2017, 5 pages.
Mexican Patent Application No. MX/A/2017/002251, Office Action dated Feb. 21, 2018, 8 pages.
Chinese Application No. 201680002343.9 , "Office Action", dated Apr. 25, 2018, 15 pages.
Chinese Application No. 201680002343.9, "Office Action", dated Aug. 26, 2019, 14 pages.
Mexican Application No. MX/A/2018/007676, "Notice of Allowance", dated Jul. 15, 2019, 2 pages.
European Application No. 16745583.1 , "Notice of Decision to Grant", dated Nov. 29, 2018, 2 pages.
Mexican Application No. MX/A/2018/007676 , "Office Action", dated Feb. 6, 2019, 13 pages.
Mexican Application No. MX/A/2018/007676 , "Office Action", dated Apr. 10, 2019, 14 pages
Mukhopadhyay, Pranfik, "Alloy Designation, Processing, and Use of AA6XXX Series Aluminium Alloys," *ISRN Metallurgy* 2012, vol. 2012, 15 pages (2012).

* cited by examiner

AA6XXX ALUMINUM ALLOY SHEET WITH HIGH ANODIZED QUALITY AND METHOD FOR MAKING SAME

CROSS-REFERENCE TO RELATED APPLICATION

This application claims the benefit of U.S. Provisional Application No. 62/194,328, filed Jul. 20, 2015, which is incorporated herein by reference in its entirety.

FIELD

Described herein are anodized quality AA6xxx series aluminum alloy sheets and a method for making these sheets.

BACKGROUND

In current consumer electronics, AA6xxx alloys, especially AA6063 and AA6463 alloys, are extensively used due to their excellent anodized quality and good mechanical and physical properties. However, due to the difficulties of simultaneously controlling the grain size, strength, and formability, these alloys are mostly produced by extrusion. The solution heat treatment (SHT) process of sheet products enhances the formability but also leads to grain growth. On the other hand, extruded billets are die quenched and artificially aged, and thus have reasonable formability and grain size. However, this process requires extensive machining which significantly reduces material yield rate. Aluminum sheet products having high formability, anodized quality, and fine grain size and efficient methods for making the same are needed.

SUMMARY

Covered embodiments are defined by the claims, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings and each claim.

Described herein are methods for making AA6xxx sheet products for use in several applications. Such sheets are currently produced from extruded billets and thus require extensive machinery. The methods described herein solve the problems with other methods and provide a process that significantly improves yield rate, productivity, cost, and energy efficiency. Specifically, described herein are methods for making high anodized quality aluminum sheets without the need for extensive machining. The present methods produce aluminum sheets with equivalent anodized quality and mechanical properties as those produced by extruded billets, but with highly improved manufacturing yield rate and efficiency.

Described herein are methods of forming an anodized quality aluminum sheet. The methods comprise providing an ingot of an AA6xxx alloy; heating the ingot to a temperature of about 560° C.; maintaining the ingot at a temperature of about 560° C. for at least about 4 hours; cooling the ingot to a temperature of from about 450° C. to about 540° C. (e.g., from about 500° C. to about 540° C.); maintaining the ingot at a temperature of from about 450° C. to about 540° C. (e.g., from about 500° C. to about 540° C.) for about 1 hour; hot rolling the ingot at a temperature of from about 250° C. to about 550° C. to form a sheet; cold rolling the sheet at a temperature of from about 20° C. to about 200° C.; subjecting the sheet to a continuous annealing and solution heat treatment at a peak metal temperature of from about 510° C. to about 550° C.; cooling the sheet to a temperature of from about 25° C. to about 50° C.; maintaining the sheet at a temperature of from about 25° C. to about 50° C.; and optionally subjecting the sheet to an aging process at a temperature of from about 25° C. to about 200° C. The alloy can be selected from the group consisting of AA6063, AA6463, AA6061, AA6111, and AA6013.

The step of heating the ingot can be performed at a heating rate of from about 30° C. per hour to about 100° C. per hour. The step of cooling the ingot can be performed at a cooling rate of from about 30° C. per hour or greater (e.g., from about 60° C. per hour or greater). The step of hot rolling the ingot can be performed for a time period of up to about 30 minutes and can result in a sheet having a thickness of from about 2 mm to about 10 mm. The step of cold rolling the sheet can be performed for a time period of up to 1 hour (e.g., from about 10 minutes to about 30 minutes). The step of cold rolling the sheet can result in a sheet having a thickness of from about 0.2 mm to about 5 mm (e.g., from about 0.5 mm to about 2 mm). The sheet can be subjected to the continuous annealing and solution heat treatment for up to about 1 minute (e.g., up to about 50 seconds). The heating rate during the continuous annealing and solution heat treatment can be from about 400° C. per minute to about 600° C. per minute.

The method can further comprise subjecting the sheet to an aging process. The aging step can comprise: heating the sheet to a temperature of about 100° C. to about 225° C.; maintaining the sheet a temperature of about 175° C. to about 200° C. for a period of time (e.g., from about 5 minutes to about 48 hours); and cooling the sheet to a temperature of about 25° C. to about 50° C.

Further provided herein are aluminum sheets made according to the method described herein. In some examples, the sheet is in the T4, T6, T7, or T8 temper state. The sheet can have a yield strength of from about 70 MPa to about 230 MPa; an ultimate tensile strength of from about 110 MPa to about 260 MPa; an elongation of from 8% to about 32%; an average grain size of from about 55 μm to about 190 μm; and/or a thermal conductivity of about 215 W/mK to about 250 W/mK.

Also provided herein are products prepared from the aluminum sheets made according to the method described herein. The product can be a consumer electronic product, a consumer electronic product part, an architectural sheet product, an architectural sheet product part, or an automobile body part.

Other objects and advantages will be apparent from the following detailed description.

DETAILED DESCRIPTION

Figure 1:
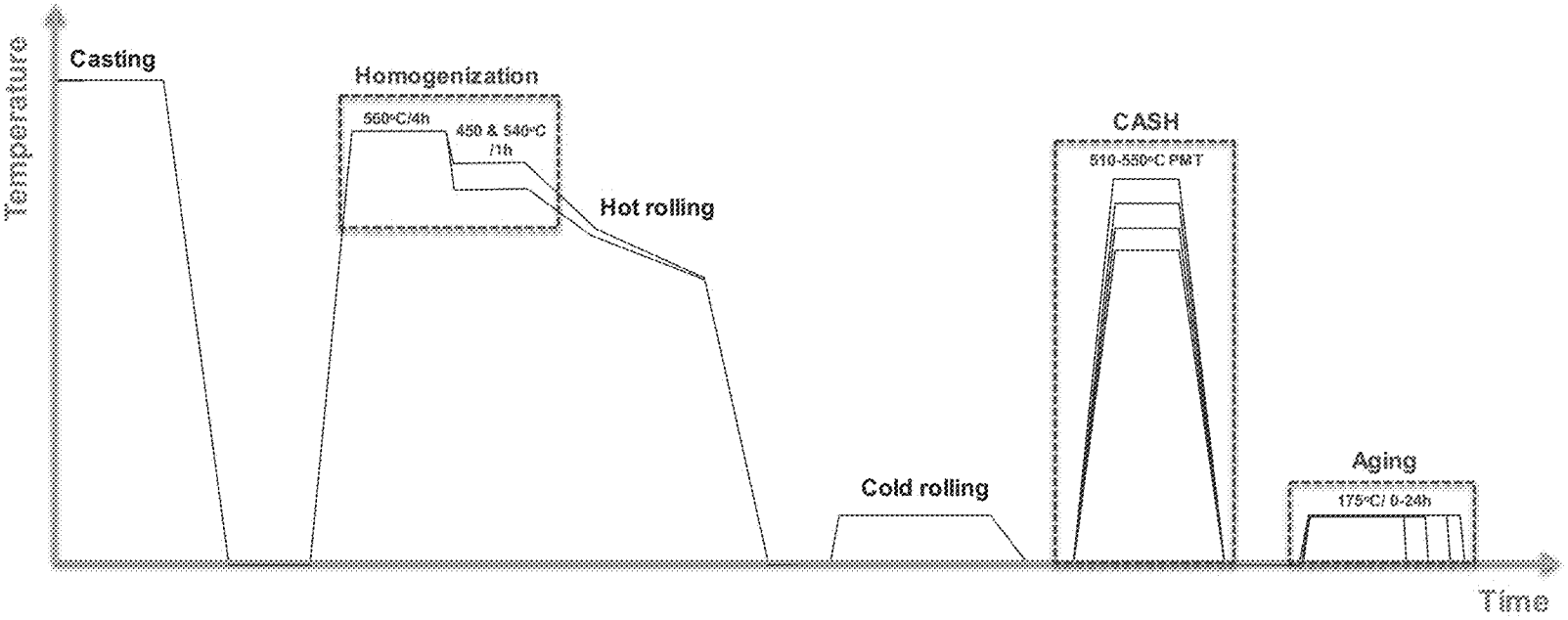
FIG. 1 is a schematic representation of processing conditions for AA6063 sheet production.

Described herein is a new process for making high anodized quality AA6xxx series aluminum sheets, without the need for extensive machining. The process described herein significantly improves yield rate, productivity, cost, and energy efficiency associated with making the aluminum sheets. As a non-limiting example, the sheets made by the process described herein have particular application in the electronics industry.

Definitions and Descriptions:

The terms "invention," "the invention," "this invention" and "the present invention" used herein are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series" or "6xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," and "the" includes singular and plural references unless the context clearly dictates otherwise.

In the following examples, the aluminum alloys are described in terms of their elemental composition in weight percent (wt. %). In each alloy, the remainder is aluminum, with a maximum wt. % of 0.15% for all impurities.

Methods of Making:

Described herein are efficient methods to make AA6xxx sheets with high anodized quality and desired mechanical and physical properties. Suitable alloys for making the sheets described herein include any alloy within the AA6xxx designation, as established by The Aluminum Association. By way of example, the AA6xxx alloys for use in preparing the sheets can include AA6063, AA6463, AA6061, AA6111, and AA6013.

Three different process parameters are intrinsic to the methods described herein, including the homogenization temperature(s), the reroll coiling temperature, and the peak metal temperature (PMT) of the continuous annealing and solution heat treatment (CASH) practice. Each of these parameters are discussed below in connection with their appropriate steps in the method of making the sheets with high anodized quality, as described herein.

The alloys described herein can be cast into ingots using a Direct Chill (DC) process. The resulting ingots can then be scalped. The DC casting process and scalping process can be performed according to standards commonly used in the aluminum industry as known to one of skill in the art. Additional cleaning and filtering during the casting process and additional scalping depth can optionally be applied to improve the surface quality of the ingot. The ingot can then be subjected to further processing steps. In some examples, the processing steps include a two-stage homogenization step, a hot rolling step, a cold rolling step, a continuous annealing and solution heat treatment (CASH) step, and optionally an aging treatment.

The homogenization step described herein is a two-stage homogenization process. The first homogenizing step dissolves metastable phases into the matrix and minimizes microstructural inhomogeneity. In the first homogenization stage, an ingot prepared from the alloy composition is heated to attain a peak metal temperature of at least about 550° C. (e.g., at least about 555° C. or at least about 560° C.). In some cases, the ingot prepared from the alloy composition is heated to attain a peak metal temperature ranging from about 550° C. to about 565° C. The heating rate to reach the peak metal temperature can be from about 30° C. per hour to about 100° C. per hour. For example, the heating rate can be about 30° C. per hour, 35° C. per hour, 40° C. per hour, 45° C. per hour, 50° C. per hour, about 55° C. per hour, about 60° C. per hour, about 65° C. per hour, about 70° C. per hour, about 75° C. per hour, about 80° C. per hour, about 85° C. per hour, about 90° C. per hour, about 95° C. per hour, or about 100° C. per hour. The ingot is then allowed to soak (i.e., maintained at the indicated temperature) for a period of time during the first homogenization stage. In some cases, the ingot is allowed to soak for at least four hours. For example, the ingot can be soaked for up to five hours (e.g., from 30 minutes to five hours, inclusively). In some cases, the ingot can be soaked at the temperature of about 560° C. for four hours.

In the second stage of the homogenization process, the ingot temperature is decreased to a temperature of from about 450° C. to 540° C. prior to subsequent processing. In some cases, the ingot temperature is decreased to a temperature of from about 500° C. to 540° C. prior to subsequent processing. For example, the ingot can be cooled to a temperature of about 500° C., about 510° C., about 520° C., about 530° C. or about 540° C. Optionally, the ingot can be cooled to the temperature used for the beginning of the hot rolling step or a temperature below the temperature used for the hot rolling step. Optionally, the ingot can be cooled to a temperature below about 450° C. and then reheated to a temperature ranging from 400° C. to 500° C. for the beginning of the hot rolling step. The cooling rate of the ingot during the second stage of the homogenization process can be from about 30° C. per hour or greater or from about 60° C. per hour or greater. For example, the cooling rate can be about 35° C. per hour, about 40° C. per hour, about 45° C. per hour, about 50° C. per hour, about 55° C. per hour, about 60° C. per hour, about 65° C. per hour, about 70° C. per hour, about 75° C. per hour, about 80° C. per hour, or about 85° C. per hour. The second stage homogenization temperature influences the extent of $Mg_2Si$ precipitation (i.e., whether $Mg_2Si$ remains dissolved in solution or precipitates out) in later stages, as further described herein. The ingot is then allowed to soak for a period of time during the second stage. In some cases, the ingot is allowed to soak at the indicated temperature for up to two hours (e.g., from 30 minutes to two hours, inclusively). For example, the ingot can be soaked at the temperature of about 540° C. for one hour.

As noted above, the homogenization temperatures are important parameters, especially during the second stage homogenization. Not to be bound by theory, it is believed that second stage homogenization at a temperature higher than $Mg_2Si$ solvus (~500° C.) keeps the precipitates in solid solution and leads to higher final strength. If the second step homogenization is carried out lower than 500° C., premature precipitation occurs and the final strength declines. Following the homogenization step, a hot rolling step can be performed. The hot rolling step can include a hot reversing mill operation and/or a hot tandem mill operation. The hot rolling step can be performed at a temperature ranging from about 250° C. to about 550° C. (e.g., from about 300° C. to about 500° C. or from about 350° C. to about 450° C.). In the hot rolling step, the ingots can be hot rolled to a 10 mm thick gauge or less (e.g., from 2 mm to 10 mm thick gauge). For example, the ingots can be hot rolled to a 9 mm thick gauge or less, 8 mm thick gauge or less, 7 mm thick gauge or less, 6 mm thick gauge or less, 5 mm thick gauge or less, 4 mm thick gauge or less, 3 mm thick gauge or less, 2 mm thick gauge or less, or 1 mm thick gauge or less. Optionally, the hot rolling step can be performed for a period of up to about 30 minutes.

At the end of the hot rolling step (e.g., upon exit from the tandem mill), the sheet can be rolled up as a coil. The reroll coiling temperature is an important parameter which also relates to $Mg_2Si$ precipitates. Specifically, the reroll coiling temperature is controlled to achieve full recrystallization and controlled $Mg_2Si$ precipitate growth. Generally, the reroll coiling temperature ranges from 385-410° C. to ensure complete recrystallization. However, excess recrystallization temperatures can cause grain and particle coarsening. In the alloy sheets for use in the methods described herein, such as the AA6063 sheets and AA6463 sheets, high reroll coiling temperature and subsequent coil cooling results in new $Mg_2Si$ precipitation or growth of pre-existing precipitates. As previously described, early precipitation of $Mg_2Si$ prior to the CASH practice will consequently result in a lower final strength of the alloy. Therefore, the reroll coiling temperature for the method described herein is about 380° C. or less (e.g., about 370° C. or less, about 360° C. or less, about 350° C. or less, about 340° C. or less, about 330° C. or less, or about 320° C. or less).

The hot rolled sheet can then undergo a cold rolling step to form a cold rolled coil or sheet. The sheet temperature can be reduced to a temperature ranging from about 20° C. to about 200° C. (e.g., from about 120° C. to about 200° C.). The cold rolling step can be performed for a period of time to result in a final gauge thickness of from about 0.2 mm to about 5 mm (e.g., about 0.5 mm to about 2 mm). Optionally, the cold rolling step can be performed for a period of up to about 1 hour (e.g., from about 10 minutes to about 30 minutes). For example, the cold rolling step can be performed for a period of about 10 minutes, about 20 minutes, about 30 minutes, about 40 minutes, about 50 minutes, or about 1 hour.

The cold rolled coil can then undergo a continuous annealing and solution heat treatment (CASH) practice. The CASH practice conditions, including the peak metal temperature (PMT) and duration of the treatment (referred to herein as the soak time), are important parameters that can dictate the final properties and microstructure of the resulting sheet.

The CASH practice can include heating the coil to a peak metal temperature of from about 510° C. to about 550° C. (e.g., about 515° C., about 520° C., about 525° C., about 530° C., about 535° C., about 540° C., about 545° C., or about 550° C.). As described above, the peak metal temperature (PMT) of the CASH practice is an important parameter for the present invention and the PMT should be carefully controlled based on desired properties, such as grain structure and/or formability. For example, the PMT should be lower than about 535° C. (e.g., from about 510° C. to about 520° C.), if fine grain structure is required to avoid orange peel type defect during forming. On the other hand, if formability is more critical and the forming deformation is not very severe, the PMT should be higher than 535° C. (e.g., from about 540° C. to about 550° C.). At temperatures of greater than about 535° C. (e.g., from about 540° C. to about 550° C.), there is increased propensity for grain growth and resulting coarse grains. The heating rate for the CASH step can be from about 400° C. per minute to about 600° C. per minute. The CASH step can be performed for a period of 2 minutes or less (e.g., 1 minute or less). For example, the CASH step can be performed for a period of from 1 second to 50 seconds.

Optionally, solution heat treated and naturally aged coils or sheets can be formed and aged for final strength. The aging process can include heating the sheet to a temperature of from about 100° C. to about 225° C. (e.g., from about 155° C. to about 200° C. or from about 170° C. to about 180° C.). The aging process can also include maintaining the sheet at a temperature of from about 150° C. to about 225° C. (e.g., from about 150° C. to about 225° C. or from about 175° C. to about 200° C.) for a period of time. Optionally, the step of maintaining the sheet in the aging process is performed for a period of from about 5 minutes to about 48 hours (e.g., from 30 minutes to 24 hours or from 1 hour to 10 hours). The aging process can further include cooling the sheet to a temperature of from about 25° C. to about 50° C.

The mechanical properties of the final product are controlled by various aging conditions depending on the desired use. T4 sheets, which refer to sheets that are solution heat treated and naturally aged, can be delivered to customers. These T4 sheets can optionally be subjected to one or more additional aging treatment(s) to meet strength requirements upon receipt by customers. For example, sheets can be delivered in other states, such as T6, T7, and T8 tempers, by subjecting the T4 sheet to an aging treatment by heating for a period of time. For example, the sheets can be heated to a temperature of from about 150° C. to about 225° C. A sheet delivered in a T6 state can be artificially aged by heating the sheet at a temperature of from about 170° C. to about 180° C. (e.g., 175° C.) for 8 hours. A sheet delivered in a T7 state can be overaged by heating the sheet at a temperature of from about 170° C. to about 180° C. (e.g., 175° C.) for 24 hours. A sheet delivered in a T8 state can be pre-strained and then artificially aged by heating the sheet at a temperature of from about 170° C. to about 180° C. for 8 hours. For the aging processes, the sheets can optionally be heated at a rate of from about 25° C. per hour to about 50° C. per hour. The heating rate can be modified based on the sheet or coil size, as understood by one of ordinary skill in the art. The resulting sheet or coil can be allowed to cool (e.g., in the ambient air) over a period of time. For example, the resulting sheet or coil can be allowed to cool over a duration of from about 30 minutes to 48 hours. The cooling rate can be 20° C. per second or less.

The resulting sheets and coils have a combination of desired properties, including high yield strength, high ultimate tensile strength, appropriate elongation, and thermal conductivity. The sheets and coils can have a yield strength of from about 70 MPa to about 230 MPa. For example, the sheets and coils can have a yield strength of about 70 MPa, 75 MPa, 90 MPa, 85 MPa, 90 MPa, 95 MPa, 100 MPa, 105 MPa, 110 MPa, 115 MPa, 120 MPa, 125 MPa, 130 MPa, 135 MPa, 140 MPa, 145 MPa, 150 MPa, 155 MPa, 160 MPa, 165 MPa, 170 MPa, 175 MPa, 180 MPa, 185 MPa, 190 MPa, 195 MPa, 200 MPa, 205 MPa, 210 MPa, 215 MPa, 220 MPa, 225 MPa, or 230 MPa.

The sheets and coils can have an ultimate tensile strength of from about 110 MPa to about 260 MPa. For example, the sheets and coils can have an ultimate tensile strength of about 110 MPa, 115 MPa, 120 MPa, 125 MPa, 130 MPa, 135 MPa, 140 MPa, 145 MPa, 150 MPa, 155 MPa, 160 MPa, 165 MPa, 170 MPa, 175 MPa, 180 MPa, 185 MPa, 190 MPa, 195 MPa, 200 MPa, 205 MPa, 210 MPa, 215 MPa, 220 MPa, 225 MPa, 230 MPa, 235 MPa, 240 MPa, 245 MPa, 250 MPa, 255 MPa, or 260 MPa.

The sheets can have an elongation of from about 8% to about 32%. For example, the sheets can have an elongation of about 8%, 10%, 12%, 14%, 16%, 18%, 20%, 22%, 24%, 26%, 28%, 30%, or 32%.

The sheets can have an average grain size of from about 50 μm to about 200 μm. For example, the sheets can have an average grain size of about 50 μm, 55 μm, 60 μm, 65 μm, 70 μm, 75 μm, 80 μm, 85 μm, 90 μm, 95 μm, 100 μm, 105 μm, 110 μm, 115 μm, 120 μm, 125 μm, 130 μm, 135 μm, 140 μm, 145 μm, 150 μm, 155 μm, 160 μm, 165 μm, 170 μm, 175 μm, 180 μm, 190 μm, 195 μm, or 200 μm.

The sheets can have a thermal conductivity of from about 215 W/mK to about 250 W/mK. For example, the sheets can have a thermal conductivity of about 215 W/mK, 220 W/mK, 225 W/mK, 230 W/mK, 235 W/mK, 240 W/mK, 245 W/mK, or 250 W/mK.

The sheets and methods described herein can be used in several applications, including electronics applications, architectural applications, and automotive applications. In some cases, the sheets can be used to prepare products, such as consumer electronic products or consumer electronic product parts. Exemplary consumer electronic products include mobile phones, audio devices, video devices, cameras, laptop computers, desktop computers, tablet computers, televisions, displays, household appliances, video playback and recording devices, and the like. Exemplary consumer electronic product parts include outer housings (e.g., facades) and inner pieces for the consumer electronic products. In some cases, the sheets can be used to prepare architectural sheet products and architectural sheet product parts. In some examples, the sheets and methods described herein can be used to prepare automobile body parts, such as inner panels.

The following examples will serve to further illustrate the methods and products without, at the same time, however, constituting any limitation thereof. On the contrary, it is to be clearly understood that resort may be had to various modifications and equivalents thereof which, after reading the description herein, may suggest themselves to those skilled in the art without departing from the spirit of the invention. During the studies described in the following examples, conventional procedures were followed, unless otherwise stated. Some of the procedures are described below for illustrative purposes.

EXAMPLE 1

Coil Preparation

Coils A, B, and C were prepared using Processes A, B, and C, respectively, using the general process shown in FIG. 1 and as detailed below. The ingot used to prepare Coils A, B, and C were cast using DC casting from an AA6063 alloy having the composition shown in Table 1 and scalped using methods known to those of skill in the art.

TABLE 1

| Si | Fe | Cu | Mn | Mg | Cr | Zn | Ti |
|---|---|---|---|---|---|---|---|
| 0.41 | 0.16 | 0.025 | 0.005 | 0.60 | 0.003 | 0.001 | 0.012 |

All expressed in wt. %;
remainder is Al.

Process A: The ingot was heated from room temperature to 560° C. and allowed to soak for approximately four hours. The ingot was then cooled to 540° C. and allowed to soak for approximately one hour. The resulting ingot was then hot rolled using a hot reversing mill and a hot tandem mill, where the ingot was hot rolled to a 5 mm thick gauge. The resulting sheet was coiled at a temperature of 380° C. The coil was then cold rolled to a 1 mm thick gauge. The cold rolled sheet was then subjected to the CASH practice, where the sheet was heated to a peak metal temperature of 520° C.

Process B: The ingot was heated from room temperature to 560° C. and allowed to soak for approximately four hours. The ingot was then cooled to 450° C. and allowed to soak for less than one hour. The resulting ingot was then hot rolled using a hot reversing mill and a hot tandem mill, where the ingot was hot rolled to a 5 mm thick gauge. The resulting sheet was coiled at a temperature of 330° C. The coil was then cold rolled to a 1 mm thick gauge. The cold rolled sheet was then subjected to the CASH practice, where the sheet was heated to peak metal temperatures of 520° C. or 540° C.

Process C: The ingot was heated from room temperature to 560° C. and allowed to soak for approximately four hours. The ingot was then cooled to 540° C. and allowed to soak for approximately one hour. The resulting ingot was then hot rolled using a hot reversing mill and a hot tandem mill, where the ingot was hot rolled to a 5 mm thick gauge. The resulting sheet was coiled at a temperature of 330° C. The coil was then cold rolled to a 1 mm thick gauge. The cold rolled sheet was then subjected to the CASH practice, where the sheet was heated to peak metal temperatures of 520° C. or 540° C.

EXAMPLE 2

Coil Property Testing

The coils prepared according to processes A, B, and C were optionally subjected to aging procedures. The T4 temper was prepared by allowing the coils to naturally age for 5 days. The T6 temper was prepared by artificially aging the coils by heating at a temperature of about 175° C. for 8 hours. The T7 temper was prepared by artificially aging the coils by heating at a temperature of about 175° C. for 24 hours. Table 2 summarizes the physical and mechanical properties of coils prepared according to processes A, B, and C at different tempers and heating to different PMTs during CASH practice. Yield strength (YS) in MPa, ultimate tensile strength (UTS) in MPa, elongation (El) in %, average grain size (μm), orange peel defect measurement (using a 5 mm bend radius) and thermal conductivity (W/mK) are presented (see Table 2).

TABLE 2

| Temper | Coils from Process A, B, or C | CASH PMT (° C.) | YS (MPa) | UTS (MPa) | El (%) | Ave. grain size (μm) | Orange peel | Thermal conductivity (W/mK) |
|---|---|---|---|---|---|---|---|---|
| T4 | A | 520 | 72.9 | 116.5 | 29.7 | 60 | Low | 233.8 |
| | B | 520 | 84.7 | 128.1 | 21.1 | 100-120 | Low | 223.6 |
| | B | 540 | 91.9 | 145.0 | 21.6 | 160-180 | Med | 217.7 |
| | C | 540 | 77.5 | 116.3 | 30.4 | 80 | Low | 229.1 |
| | C | 520 | 72.4 | 124.7 | 29.8 | 120-130 | Low | 222.3 |
| T6 | A | 520 | 131.2 | 164.9 | 15.2 | 60 | Low | 239.7 |
| | B | 520 | 223.0 | 246.8 | 11.4 | 100-120 | Low | 234.2 |
| | B | 540 | 225.0 | 248.7 | 11.1 | 160-180 | Med | 233.3 |
| | C | 520 | 145.5 | 178.4 | 14.1 | 80 | Low | 236.7 |
| | C | 540 | 188.1 | 217.2 | 12.2 | 120-130 | Low | 234.2 |

TABLE 2-continued

| Temper | Coils from Process A, B, or C | CASH PMT (° C.) | YS (MPa) | UTS (MPa) | El (%) | Ave. grain size (μm) | Orange peel | Thermal conductivity (W/mK) |
|---|---|---|---|---|---|---|---|---|
| T7 | A | 520 | 140.2 | 168.9 | 14.2 | 60 | Low | 243.5 |
| | B | 520 | 215.4 | 237.8 | 10.6 | 100-120 | Low | 235.0 |
| | B | 540 | 222.9 | 244.8 | 10.5 | 160-180 | Med | 234.2 |
| | C | 520 | 156.2 | 185.2 | 12.4 | 80 | Low | 238.0 |
| | C | 540 | 185.9 | 212.6 | 11.5 | 120-130 | Low | 234.6 |

As shown in Table 2, various physical and mechanical properties, as required by a customer, can be obtained by controlling the process described herein. For example, if customers require very soft and highly formable alloy sheets, the desired sheets can be provided as T4 temper. If higher strength and moderate formability are required, sheets can be prepared as T6 or T7 temper. For example, a T6 sheet of a coil prepared according to Process B can be used by manufacturers who want to stamp AA6063T6 sheets having 150 MPa YS into products displaying medium to low orange peel defect after forming. Coils prepared according to Process A samples can be used by manufacturers who require a combination of excellent surface and formability, with less emphasis on strength. Within the same temper, there are various strength-formability combinations. These results demonstrate that a range of mechanical properties can be obtained. Further mechanical properties can be obtained with adjustments, as needed.

EXAMPLE 3

Aging Curves

Figure 2:
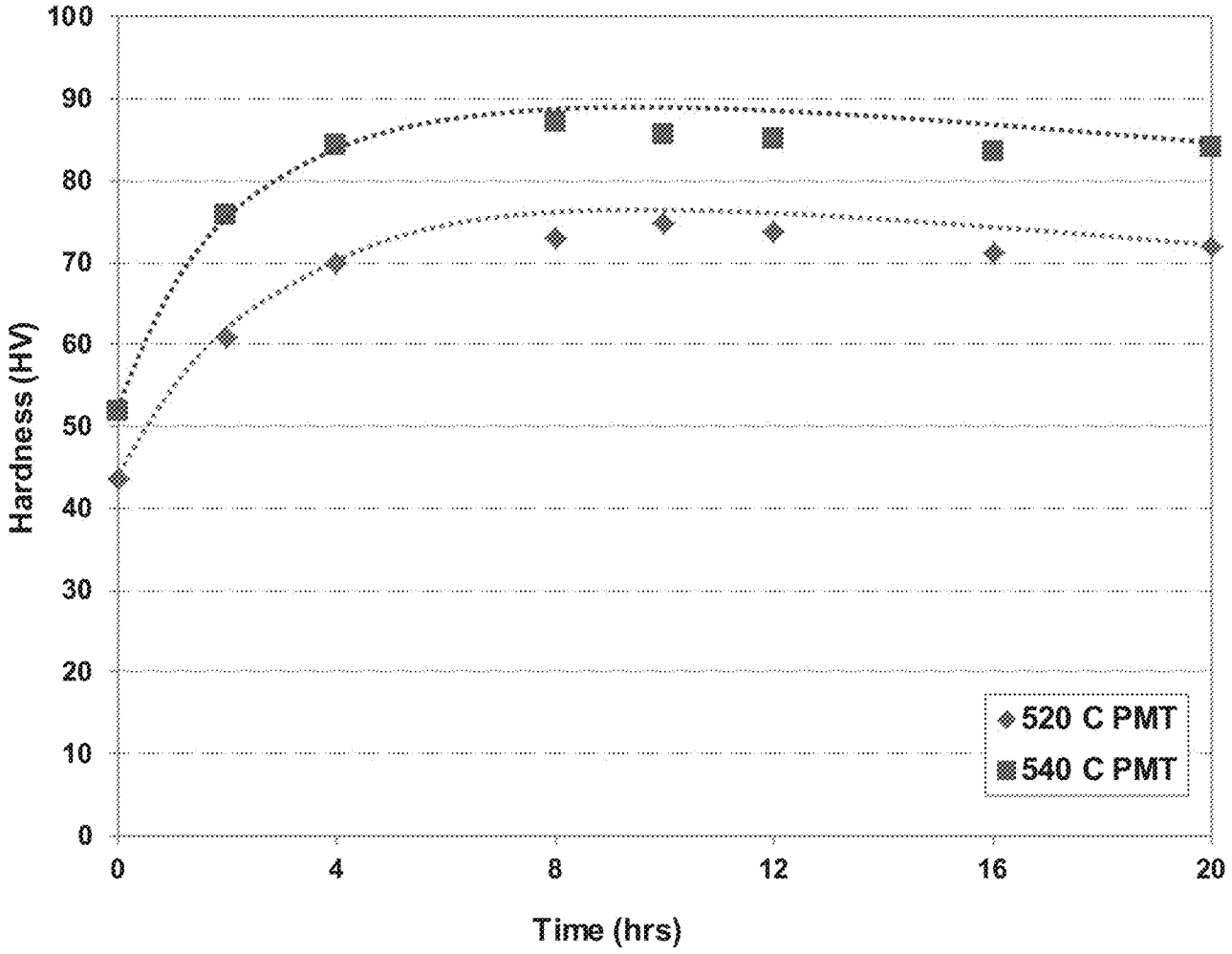
FIG. 2 is a schematic representation of aging curves of AA6063 alloy sheets after CASH practice at peak metal temperatures (PMTs) of 520° C. and 540° C.

AA6063 alloy sheets prepared from the composition from Table 1 were processed using the CASH practice by heating to peak metal temperatures of 520° C. and 540° C. The sheets were allowed to age at 175° C. for 20 hours. The hardness was determined at different intervals throughout the aging process and aging curves were prepared for each of the alloys (see FIG. 2). As shown in FIG. 2, the maximum strength for each of the alloy sheets was obtained after heating for 8 hours. This result indicates the heat treatment conditions necessary to achieve desirable hardness properties.

All patents, publications and abstracts cited above are incorporated herein by reference in their entirety. Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the present invention as defined in the following claims.

What is claimed is:

1. A method of forming an aluminum sheet comprising:

providing an ingot of an AA6xxx alloy;

in a first stage homogenization step, heating the ingot to a first stage homogenization temperature of about 560° C. and soaking the ingot at the first stage homogenization temperature of about 560° C. for at least about 4 hours;

in a second stage homogenization step, cooling the ingot from the first stage homogenization temperature to a second stage homogenization temperature of from 500° C. to 540° C. and soaking the ingot at the second stage homogenization temperature of from 500° C. to 540° C. for about 1 hour;

cooling the ingot from the second stage homogenization temperature to a hot rolling temperature of from about 250° C. to about 450° C.;

hot rolling the ingot at the hot rolling temperature to form a sheet;

cold rolling the sheet at a cold rolling temperature of from about 20° C. to about 200° C.;

subjecting the sheet to a continuous annealing and solution heat treatment at a peak metal temperature of from about 510° C. to about 550° C.;

cooling the sheet to a cooling temperature of about 25° C. to about 50° C.; and maintaining the sheet at the cooling temperature of about 25° C. to about 50° C.

2. The method of claim 1, wherein the alloy is selected from the group consisting of AA6063, AA6463, AA6061, AA6111, and AA6013.

3. The method of claim 1, wherein the step of heating the ingot is performed at a heating rate of from about 30° C. per hour to about 100° C. per hour.

4. The method of claim 1, wherein the step of cooling the ingot from the first stage homogenization temperature to the second stage homogenization temperature is performed at a cooling rate of from about 30° C. per hour or greater.

5. The method of claim 1, wherein the step of cooling the ingot from the first stage homogenization temperature to the second stage homogenization temperature is performed at a cooling rate of from about 60° C. per hour or greater.

6. The method of claim 1, wherein the step of hot rolling the ingot is performed for a time period of up to about 30 minutes.

7. The method of claim 1, wherein the step of hot rolling the ingot results in a sheet having a thickness of from about 2 mm to about 10 mm.

8. The method of claim 1, wherein the step of cold rolling the sheet is performed for a time period of up to about 1 hour.

9. The method of claim 1, wherein the step of cold rolling the sheet results in a sheet having a thickness of from about 0.2 mm to about 5 mm.

10. The method of claim 1, wherein the sheet is subjected to the continuous annealing and solution heat treatment for up to about 1 minute.

11. The method of claim 1, wherein the heating rate during the continuous annealing and solution heat treatment is from about 400° C. per minute to about 600° C. per minute.

12. The method of claim 1, further comprising an aging process comprising:

heating the sheet to an aging temperature of from about 100° C. to about 225° C.;

maintaining the sheet at the aging temperature for a period of time; and cooling the sheet to a reduced temperature of from about 25° C. to about 50° C.

13. The method of claim 12, wherein the step of maintaining the sheet in the aging process is performed for a period of from about 5 minutes to about 48 hours.

14. The method of claim 1, further comprising rolling the sheet as a coil at a reroll coiling temperature of 380° C. or less after the hot rolling step.

15. A method of forming an aluminum sheet comprising:

providing an ingot of an AA6xxx alloy;

in a first stage homogenization step, heating the ingot to a first stage homogenization temperature of at least about 550° C. and soaking the ingot at the first stage homogenization temperature of at least about 550° C. for at least about 4 hours;

in a second stage homogenization step, cooling the ingot from the first stage homogenization temperature to a second stage homogenization temperature of from 500° C. to 540° C. and soaking the ingot at the second stage homogenization temperature of from 500° C. to 540° C. for a period of time;

cooling the ingot from the second stage homogenization temperature to a hot rolling temperature of from about 250° C. to about 450° C.;

hot rolling the ingot at the hot rolling temperature to form a sheet;

cold rolling the sheet at a cold rolling temperature of from about 20° C. to about 200° C.;

subjecting the sheet to a continuous annealing and solution heat treatment at a peak metal temperature of from about 510° C. to about 550° C.;

cooling the sheet to a cooling temperature of about 25° C. to about 50° C.; and maintaining the sheet at the cooling temperature of about 25° C. to about 50° C.

* * * * *